United States Patent [19]

Mailliet

[11] 4,097,033

[45] Jun. 27, 1978

[54] DRILLING MACHINE FOR BLAST FURNACE TAPHOLES

[75] Inventor: Pierre Mailliet, Howald, Luxembourg

[73] Assignee: S. A. des Anciens Etablissements Paul Worth, Luxembourg, Luxembourg

[21] Appl. No.: 770,191

[22] Filed: Feb. 18, 1977

[30] Foreign Application Priority Data

Feb. 20, 1976 Luxembourg ..... 74398

[51] Int. Cl.[2] ..... C21B 7/12

[52] U.S. Cl. ..... 266/271

[58] Field of Search ..... 266/271, 272, 273

[56] References Cited

U.S. PATENT DOCUMENTS

| | | | |
|---|---|---|---|
| 3,190,629 | 6/1965 | Draper | 266/271 |
| 3,549,141 | 12/1970 | Zimmermann | 266/271 |
| 3,765,663 | 10/1973 | Legille et al. | 266/273 |

*Primary Examiner*—Gerald A. Dost

[57] ABSTRACT

A blast furnace taphole drilling apparatus is mounted so as to be movable, between the taphole drilling and retracted positions, in an inclined plane. The mounting means for the drilling apparatus permits the vertical and/or angular adjustment of the drill bit and the drill is held in the operative position solely under the influence of hydraulic pressure. Motive fluid for the drill of the taphole drilling apparatus is delivered to the drill, which is mounted for movement along a support beam, either by a rigid conduit system or via flexible conduits which are played out from and rewound on a reel.

23 Claims, 36 Drawing Figures

FIG. 22
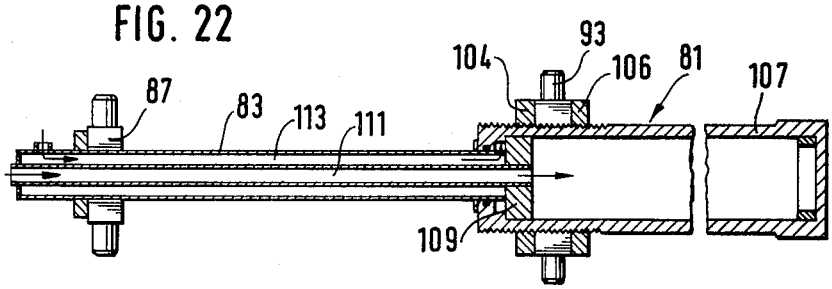
FIG. 23
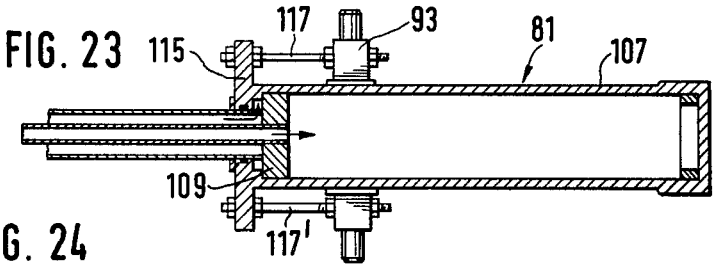
FIG. 24
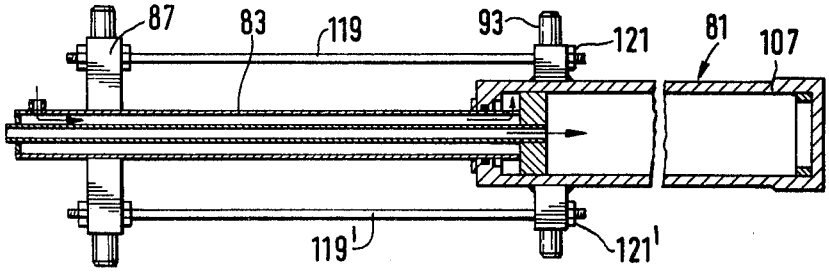
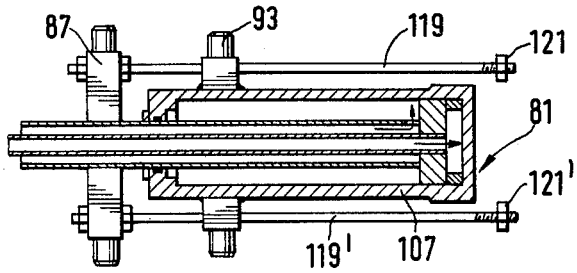
FIG. 25

FIG. 26A
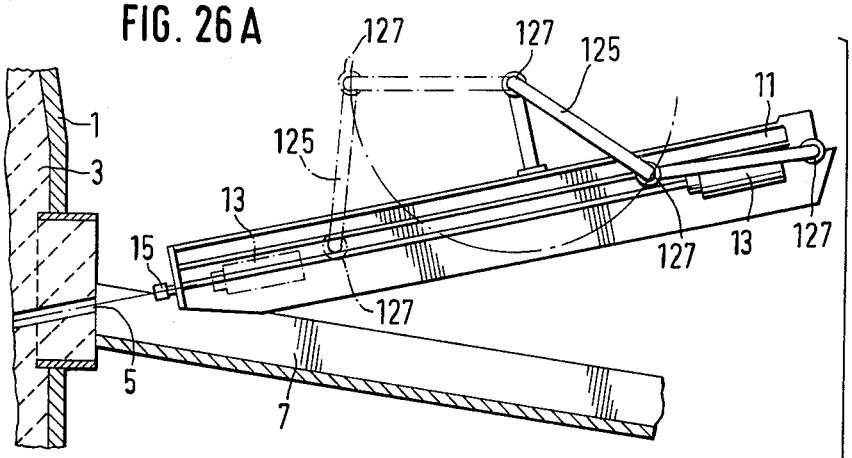
FIG. 26
FIG. 26B
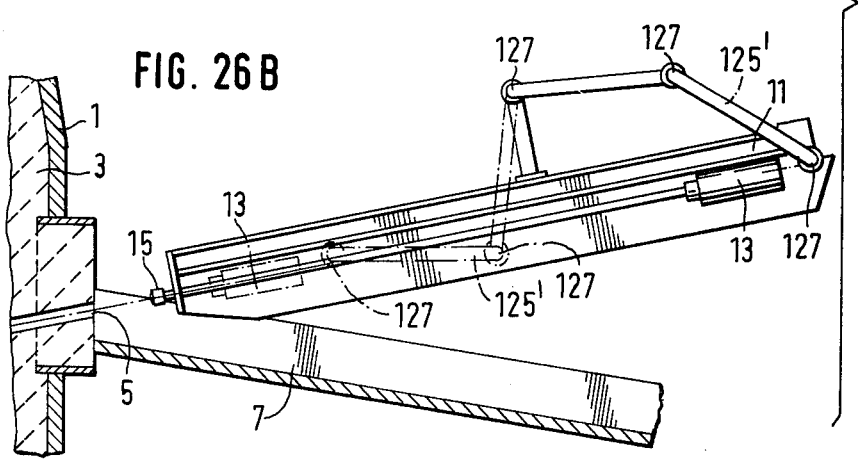
FIG. 28
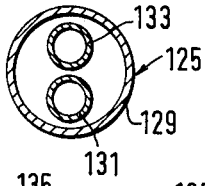
FIG. 29
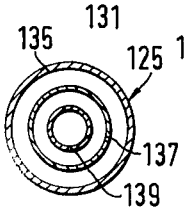
FIG. 30
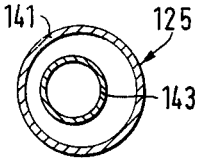
FIG. 27
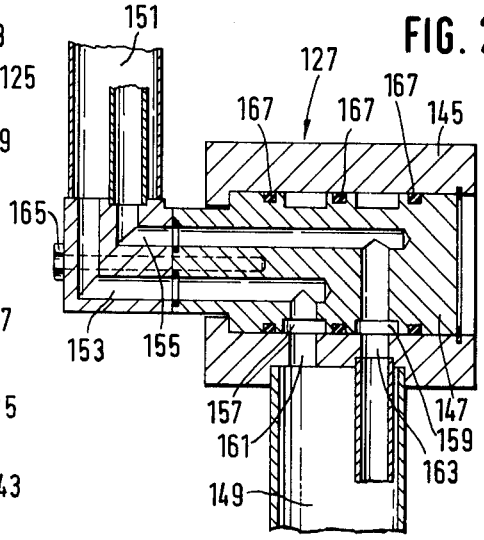

DRILLING MACHINE FOR BLAST FURNACE TAPHOLES

BACKGROUND OF THE INVENTION

The present invention relates to a machine for drilling tapholes of shaft furnaces, particularly of blast furnaces.

It is known that present progress in the design of blast furnaces provides for increasingly large units and for the adoption of increasingly high pressures in the furnace throat. One of the consequences of this tendency is the use of increasingly hard materials for sealing tapholes, while production requirements and the increasing length of these tapholes require high speed drilling means. It is therefore advisable to have robust and simple drilling machines available which will enable high stresses to be applied and transmitted, particularly the pressures required for the drilling tools.

The increase in the number of tapholes and other items of equipment required for the satisfactory operation and maintenance of blast furnaces, such as the working platforms, reduces the space available around the furnace. Such space limitations have to be taken into account when designing the drilling machine in order to avoid movements necessitating a great deal of free space. The problems facing the designers of these drilling machines are rendered still more complicated by other limitations of a purely geometrical nature, particularly the necessity of enabling the drilling tool or tools to be withdrawn without having to touch the tap spout.

In the known drilling machines in general use the operation of positioning the bar on which the drilling tool slides usually involves the displacement of the said bar in an approximately horizontal plane, until it is above the tap spout, followed by a vertical displacement, e.g. by a pivoting movement, in order to lower the bar into the operating position, in which it is then locked mechanically. The withdrawal of the bar to an inoperative position obviously entails the same movements in the reverse order. These compound movements are required by reason of the fact that the nose of the bar bearing the drilling tool must necessarily be lowered fairly down into the tap spout and that impact against the edges of the latter must be avoided at all costs, both when the drilling tool is being positioned for operation and when it is being withdrawn. The mechanisms for the displacement of the bar, which are already complicated in themselves, to enable these movements to be effected, are rendered still more so by the auxiliary mechanisms for the stepless adjustment of the angle of application of the bar and also for the selection of its horizontal and vertical positions. All these regulating and displacement mechanisms are generally provided at the sacrifice of the rigidity of the machine as a whole, a drawback incompatible with present-day needs.

Furthermore, the means for displacing the bar and also those for actuating the working tool generally consist of hydraulic or pneumatic motors, for which purpose a set of flexible tubes is provided in order to convey the driving fluid between the various moving elements and components. These flexible tubes, generally made of rubber, not only prove cumbersome and inconvenient but are also a constant potential source of accidents, as they are suspended above the tap spout during operation and thus occupy a position subject to a very high temperature.

SUMMARY OF THE INVENTION

The drilling machine of the present invention reduces or eliminates the aforementioned drawbacks of the prior art, and provides a drilling machine which can accurately be moved into the working position by simple movements. In addition, the drilling machine of the present invention can be constructed on simple lines and with the required degree of rigidity and without excessive height, thus making possible selection of both the withdrawal position for the drilling tool bar and also the trajectory of the movement by which it is conveyed into the said position as desired and in accordance with the space available around the furnace.

In accordance with the present invention a shaft furnace taphole drilling machine, particularly a drilling machine for a blast furnace, has a tool holder bar positioned at the free end of a stem or arm, the other end of the stem or arm being borne by a support column. A hydraulic driving device pivots the stem and the bar about the support column from a working position to a retracted position and vice versa, the longitudinal axis of the support column being inclined in relation to the vertical. The hydraulic driving device comprises means for limiting the amplitude to which it can be extended, means for ensuring that the extreme extended position thus selected will correspond to the operating position of the tool holder bar, and means for maintaining the pressure of the hydraulic fluid in the said extreme extended position during the operation of the drilling machine.

In accordance with a first embodiment of the invention the stem consists of one single supporting arm with which the tool holder bar forms a predetermined angle. There is no hinged connection between the stem and the tool holder bar; rather the connection is a rigid and adjustable connection enabling a more stable construction.

In one advantageous embodiment of the invention the hydraulic or pneumatic fluid serving to actuate the working tool is conveyed through a rigid system of piping consisting of a number of branches pivotable in relation to one another in one plane by means of articulated joints interconnecting the adjacent ends of two adjacent branches.

According to a further embodiment, the hydraulic or pneumatic fluid is conveyed via flexible conduits which are wound on and unwound from a reel.

Other features, advantages and objectives of the present invention will be apparent to and understood by those skilled in the art from the following detailed description and drawings.

BRIEF DESCRIPTION OF THE DRAWINGS

In the drawings, wherein like elements are numbered alike in the several figures;

FIGs. 22–25 are longitudinal sections through different embodiments of the hydraulic jack with a moving cylinder and a fixed piston.

FIG. 26 shows a first embodiment of the piping system through which hydraulic or pneumatic fluid is fed to the drilling machine.

FIG. 27 is a section across one of the articulated joints used for the pipes shown in FIG. 26.

FIGS. 28–30 are cross sections through the feed pipes.

Figure 1:
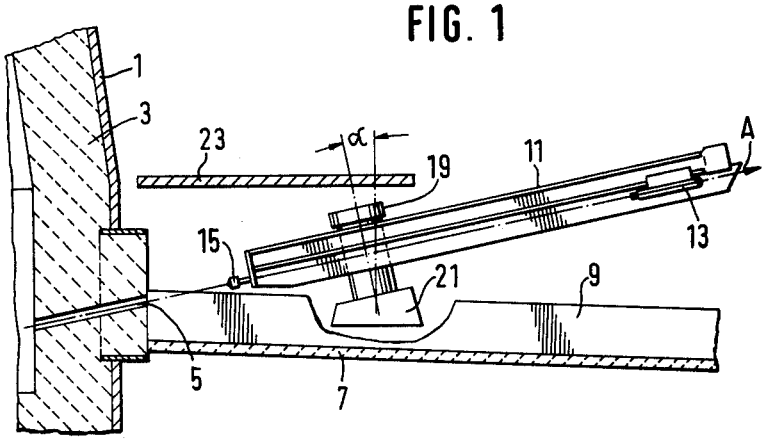
FIG. 1 is a schematic vertical section through part of a blast furnace, comprising a taphole and a tap spout and a machine serving to drill the taphole.
Figure 2:
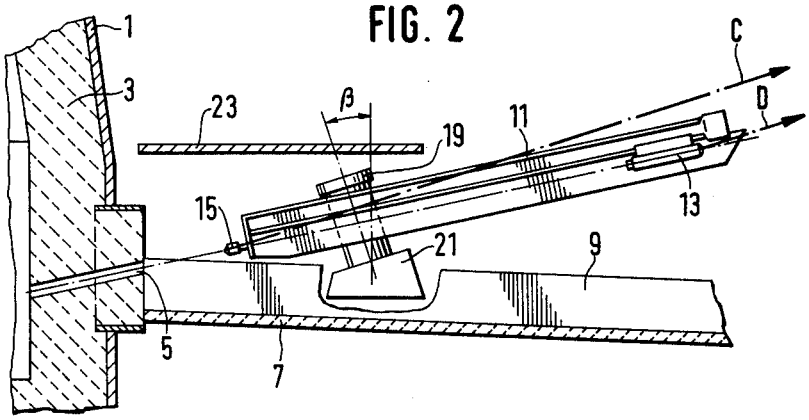
FIG. 2 is a view similar to that of FIG. 1, with a different angle of inclination for the support column about which the tool holder bar pivots.

DESCRIPTION OF THE PREFERRED EMBODIMENTS:

With reference to FIGS. 1 and 2, the outer wall of a blast furnace is indicated at 1. The furnace is provided with a lining of refractory brick 3 which abuts the wall 1. As is common practice, the furnace is provided with one or more tapholes, such as the taphole 5, whereby communication can be established between the interior of the furnace and the spout 7; the tapholes being plugged with "clay" until withdrawal of molten metal from the furnace is desired. The furnace wall is, in accordance with conventional practice, of increased thickness in the vicinity of the tapholes 5. At the appropriate time, the taphole will be opened through the use of a taphole drilling machine and the molten metal will be discharged from the furnace via the taphole and the spout 7; the metal being contained in this spout by the lateral sidewalls 9 thereof.

Figure 3:
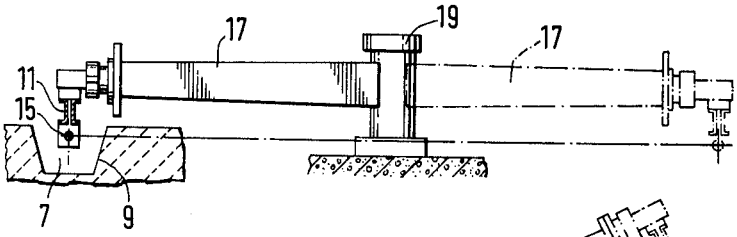
FIGS. 3–5 show lateral views of the drilling machine, with different angles of inclination for the support column.
Figure 4:
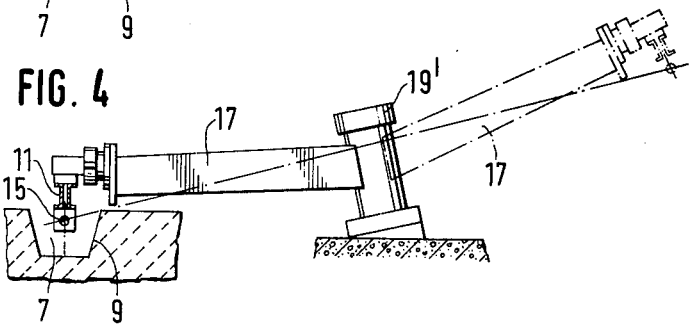
Figure 5:
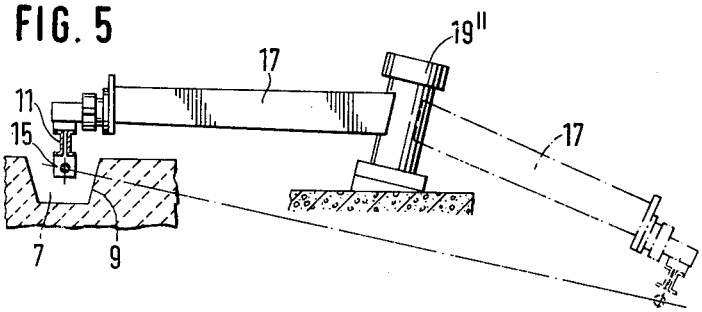

The taphole drilling machine comprises a support bar 11, which may in part be in the form of an "I" beam, on which a drill 13 is mounted for movement. The drill 13 is connected to operate a drilling tool or bit 15. As may best be seen from FIGS. 13–15, the support bar 11 is affixed to a stem or arm 17. Referring to FIGS. 3–5, it may be seen that arm 17 is mounted on a support column 19. Support column 19 serves as a pivot for arm 17. A driving mechanism, not shown, moves arm 17 and bar 11 between the retracted and operative positions with the movement being in either a horizontal or an inclined plane.

Support column 19 is advantageously secured in a concrete base 21 and, according to one of the principal characteristics of the present invention, is inclined in the direction of the blast furnace relative to a vertical plane as indicated by the angles $\alpha$ and $\beta$ in FIGS. 1 and 2. Inclination of column 19 permits the movements of bar 11 to be in an inclined plane whereby the drilling mechanism will be raised as it is withdrawn from the taphole and, conversely, the drilling machine will be caused to descend in the direction of the spout 7 until bit 15 is aligned with taphole 5 when it is desired to tap the furnace.

Thus, in accordance with the present invention, the drilling machine, and particularly the bar 11, may be moved to and withdrawn from the working position in a single movement. This may be contrasted with the prior art wherein drilling machines have had to be initially displaced in an approximately horizontal plane until above the spout and thereafter lowered vertically into the spout. The prior art requirement for two independently operable displacement mechanisms for the drill has resulted from the fact the the operative position of the drilling mechanism, and specifically the bit 15, was with the bit situated between the lateral walls 9 of the spout 7. This operative position obviously precludes horizontal pivoting motion of the support bar 11 since contact between the support bar or drill bit and the walls 9 of spout 7 would result.

In addition to simplifying the support mechanism for the drilling machine, a significant advantage of the present invention resides in the fact that the drilling machine is of a very moderate height and is lowered as the bit approaches the taphole. Accordingly, referring again to FIGS. 1 and 2, when employing the present invention it is unnecessary to provide for a discontinuity in the service platform 23 which is customarily provided about the periphery of the furnace. In the prior art it has been necessary to establish interruptions in the platform 23 in vertical alignment with the spouts 7 when a furnace was to be tapped.

As will be obvious from FIGS. 1 and 2, the angle of inclination of support bar 11 with respect to the horizontal determines the angle of inclination of the taphole 5. In FIG. 1 the angle of inclination of the support column 19 with respect to the vertical is equal to that of the bar 11 with respect to the horizontal. Accordingly, support bar 11 will always remain in the same inclined plane as indicated by the arrow A throughout its movement with respect to support column 19. In the arrangement depicted in FIG. 2, the angle $\beta$ of support column 19 with respect to the vertical differs from the angle of inclination of support bar 11 with respect to a horizontal plane. Thus, in the FIG. 2 arrangement, support bar 11 will be displaced, between parallel planes indicated by arrows C and D, as it is moved between the operative and inoperative positions.

FIGS. 3–5 are schematic representations of three different arrangements of the present invention viewed in the direction of the spout 7. In FIGS. 3–5 the drilling machine is shown in the operative position in full lines and in the retracted position by means of broken lines. The retracted positions may be offset with respect to the operative positions by, for example, 120° or 180°.

The support column 19′ in FIG. 4 is inclined in the direction of the furnace and is also inclined in the direction of the spout 7. The angle defined by the junction between arm 17 and support column 19 is thus, unlike the relationship of the embodiment of FIG. 3, other than 90° . Accordingly, in the FIG. 4 embodiment the support bar 11 will be higher above the ground when in the retracted position when compared to the FIG. 3 embodiment.

The selection of which of the embodiments of FIGS. 3–5 will be employed will be dependent upon the space available about the furnace and particularly by the presence of obstructions in the area swept by the arm 17 and support bar 11 during movements between the retracted and operative positions of the drilling machine. Thus, it is possible in accordance with the present invention to select the height of the retracted position of the drilling machine so as to insure the easiest access to the drilling tool for servicing from either the service platform 23 or the ground; such access preferably being achieved without the need of a lift. As will be obvious to those skilled in the art, different geometrical configurations from those depicted in FIGs. 3–5 may be selected if necessary.

Figure 6:
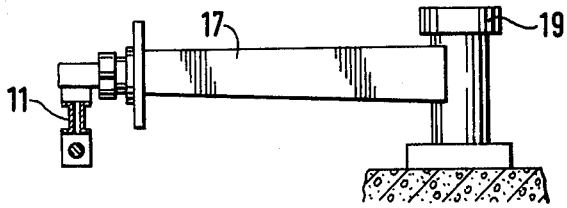
FIGS. 6–8 show schematic diagrams of a first version of the invention, with facilities for adjusting the height at which the tool holder bar is affixed in relation to the stem.
Figure 7:
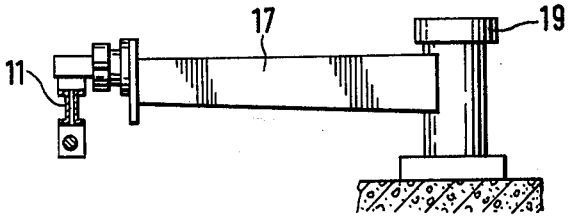
Figure 8:
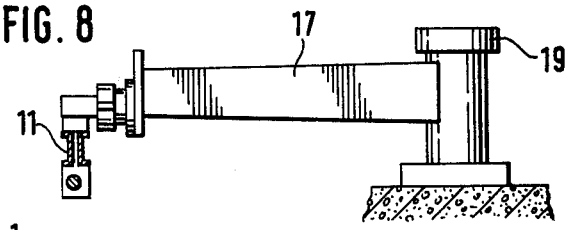
Figure 9:
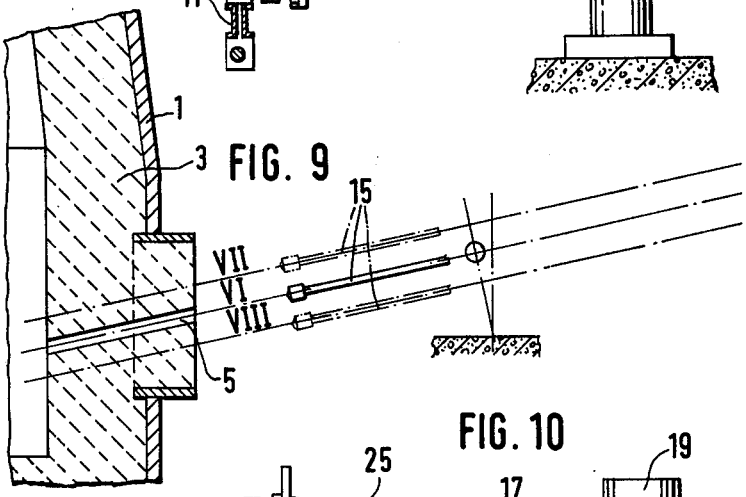
FIG. 9 is a schematic diagram showing different positions, in the vertical direction, for the drilling tool, corresponding to the positions shown in FIGS. 6–8 for the bar.

FIGS. 6–8 schematically illustrate three different positions of the support bar 11 with respect to the arm 17. Although support bar 11 is rigidly connected to arm 17, nevertheless means may be provided for changing the height of bar 11 to thereby change the vertical position of the taphole 5. Thus, the arrangements illustrated in FIGs. 6–8 contemplate the securing of bar 11 to the end of arm 17 by means of bolts whereby the bar may be raised or lowered with respect to the end of arm 17. The positions of support bar 11 in FIGS. 6, 7 and 8 respectively correspond to the vertical positions VI, VII and VIII of the drill bit 15 as depicted in FIG. 9.

Since it is rarely necessary to change the drilling height, the present invention contemplates a rigid or semi-rigid connection between arm 17 and bar 11 rather than for a hinged connection which, while providing numerous possibilities of adjustment, would inevitably detract from the rigidity of the drilling machine.

Figure 10:
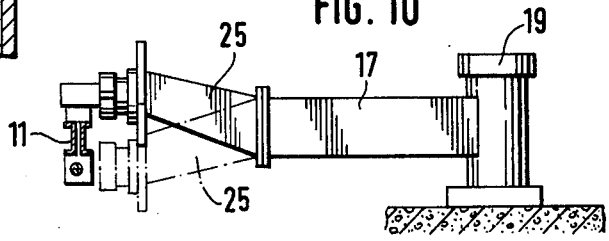
FIG. 10 shows a second embodiment, serving to adjust the height at which the bar is fixed in relation to the stem.

With reference to FIG. 10, a further version of means for changing the height of the support bar 11 is shown. In FIG. 10 one or more angled arm sections 25 are interposed between the support bar 11 and the end of arm 17. Since the intermediate member or members 25 form a preselected angle with respect to the axis of arm 17, the bar 11 may be raised or lowered merely by selection of the appropriate intermediate member or members and rigidly connecting the selected member or members to both bar 11 and arm 17. It may be noted that an angled intermediate member 25 may be incorporated in the embodiments of FIGS. 6–8 if necessary.

Figure 11:
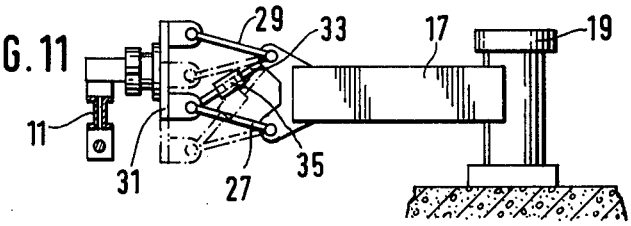
FIG. 11 is a schematic diagram of a third embodiment, serving to change the height at which the bar is fixed in relation to the stem.
Figure 12:
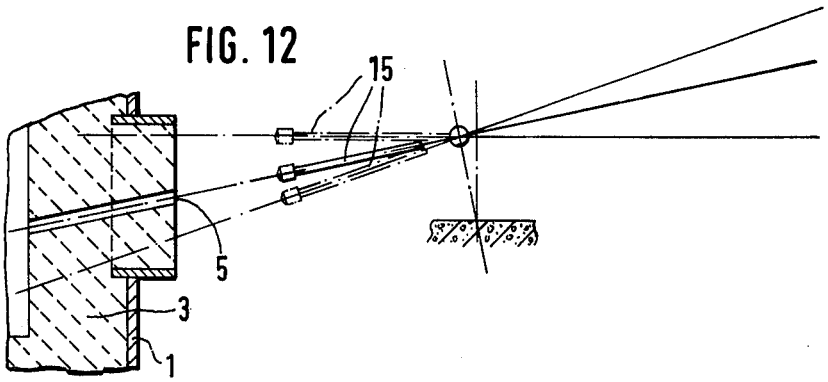
FIG. 12 shows the drilling tool at various angles of inclination in relation to the wall of the furnace.

As noted above, the embodiments of FIGS. 6–8 and 10 contemplate rigid connections between the support bar 11 and the arm 17. By way of contrast, the embodiment of FIG. 11 comprises a semi-rigid connection between bar 11 and arm 17. This semi-rigid connection includes a pair of plates or arms 27 and 29 which are articulated, at their opposite ends, to the end of arm 17 and to a flange 31 affixed to the support bar 11. Thus, the plates or arms 27 and 29 cooperate with flange 31 and the end of arm 17 to form an articulated coupling of the parallelogram type. A cross member 33 having an adjustable length is provided to enhance the rigidity of the parallelograph connection. Member 33 is connected to diagonally opposite points of the parallelogram and the length of member 33 will determine the height of support bar 11. For the purpose of adjusting the length of member 33, and thus the height of support bar 11, member 33 may comprise a pair of threaded rods and an internally threaded adjustment member 35 whereby member 33 is effectively a turnbuckle which enables the height of the support bar 11 to be steplessly regulated.

Means for angularly adjusting the support bar 11 in a vertical plane are depicted in FIGS. 12–19. As shown schematically in FIG. 12, such angular adjustment enables support bar 11 and thus the drill bit 15 to be rotated so as to vary the angle of inclination of the taphole 5. As in the case of the vertical adjustment of the drill bit, as discussed above with respect to FIGS. 6–11, the angle of inclination of the taphole need rarely be changed. Accordingly, a rigid and robust construction, whereby the angle of inclination will not be varied as a result of vibrations produced during operation of the drilling machine, is of more importance than facilitating adjustment of the angle of inclination of the drill bit 15.

Figure 13:
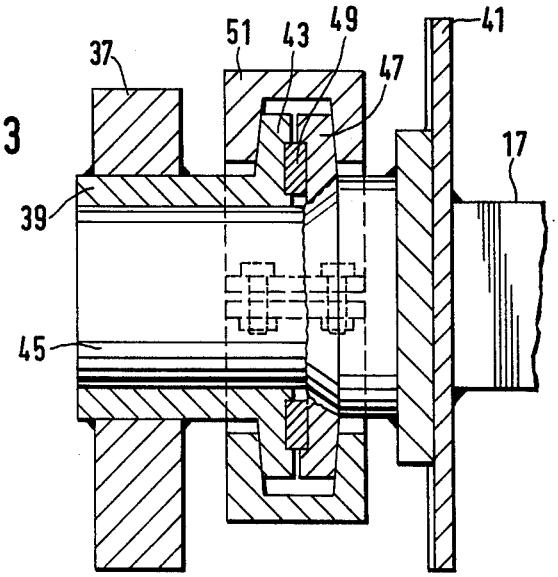
FIGs. 13–15 are schematic diagrams of a first embodiment enabling the angle of inclination of the drilling tool to be adjusted in accordance with FIG. 12.
Figure 14:
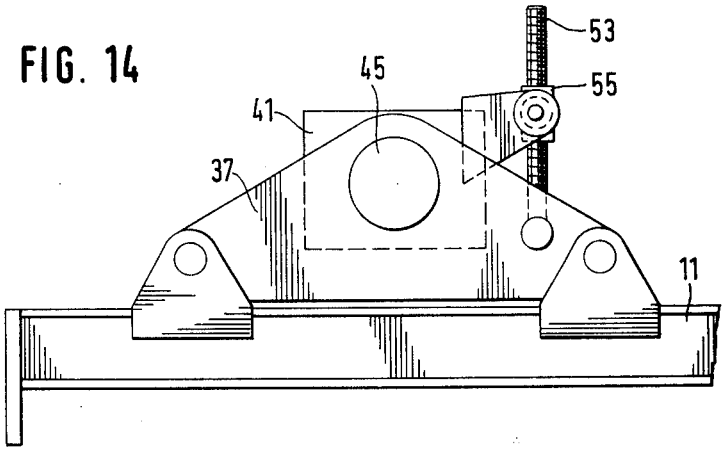
Figure 15:
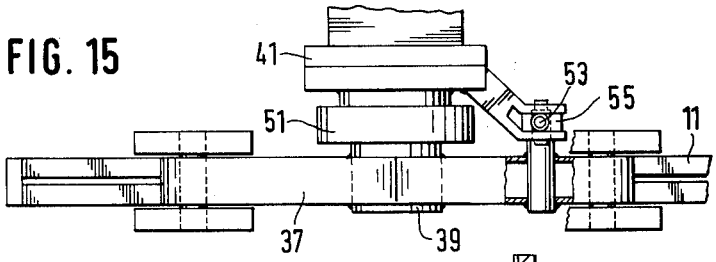

Referring now to FIGS. 13–15, means for establishing a rigid but angularly adjustable connection between support bar 11 and arm 17 is shown. Referring jointly to FIGs. 13–15, the support bar 11 is suspended from a bracket 37 which is integral with a hollow sleeve 39. Sleeve 39 is provided with an outwardly extending flange 43; flange 43 being provided with a sloped surface which faces bracket 37 and also being provided with an annular groove in its opposite face. Sleeve 39 is supported on a shaft 45, which is also provided with an outwardly extending flange 47, which forms an extension of arm 17. As will be described below, flange 47 on shaft extension 45 cooperates with flange 43 on sleeve 39. Flange 47 is also provided with an annular groove, which faces the groove in flange 43, and with a sloped surface on its opposite face. Shaft extension 45, which is of cylindrical shape, is integral with a flange 41 affixed to the end of arm 17. A collar 51 engages the oppositely facing sloped external surfaces of flanges 43 and 47. When collar 51 is released, sleeve 39 is able to rotate about shaft extension 45 and thus support bar 11 may be pivoted in a vertical plane about the longitudinal axis of arm 17. A ring 49, comprised of a material with a high coefficient of friction such as the commercially available material "FERODO", is received in the facing annular grooves of flanges 43 and 47 and increases the friction between these flanges. The groove in collar 51 which receives the flanges 43 and 47 is provided with a trapezoidal cross-section which interacts with the inclined external surfaces of flanges 43 and 47 whereby tightening of collar 51 generates axial compressive stress, enhanced by the pressure of friction ring 49, whereby there will be no slippage.

To insure that the support bar 11 will not tilt under the effect of its own weight during the release of collar 51, and in order to facilitate the angular adjustment of the support bar 11, an adjustable connection is provided between bracket 37 and arm 17. As may be seen from FIGS. 14 and 15, this adjustable connection is in the form of a threaded rod 53. Rod 53 is attached at a first end to bracket 37 and passes through a coupling 55. Coupling 55 is, in turn, rigidly connected to arm 17 via flange 41. Bar 11 can be pivoted by causing rod 53 to slide with respect to coupling 55 by, for example, adjusting nuts on the rod at both sides of coupling 55. Other adjustment means can, of course, be employed.

Figure 16:
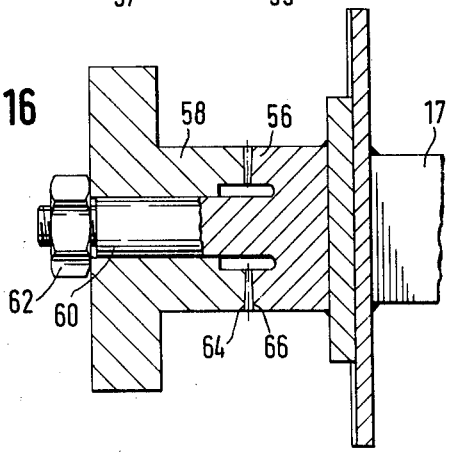
FIGS. 16–19 are schematic diagrams of a second embodiment enabling the angle of inclination of the drilling tool to be adjusted in accordance with FIG. 12.
Figure 17:
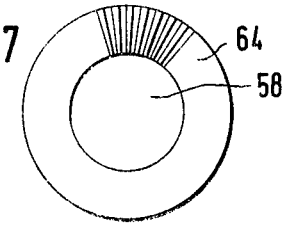
Figure 18:
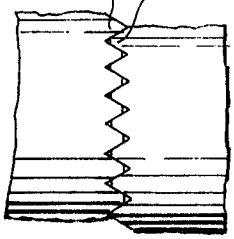

Considering now the adjustment scheme of FIG. 16, a stem or extension 56 is integral with the arm 17. A tubular axially aligned second stem 58 is connected to a drill support bar, which has not been shown in the drawing, either rigidly or via an adjustable securing system such as that shown in FIG. 19. Stem 58 interacts with stem 56 in the manner to be described below. The stem 58 is provided with an axial bore while stem 56 includes an extension 60 of reduced diameter which will pass through the bore in stem 58. The end of extension 60 is threaded and a securing nut 62 is provided to hold the stem 58 in abutting relationship with the stem 56. The abutting surfaces or rims of stems 56 and 58, as respectively indicated at 66 and 64, are provided with complimentary radial corrugations, as shown in FIGS. 17 and 18, whereby the stems 56 and 58 may be caused to engage one another. These radial corrugations can be provided by milling or any other suitable technique. With reference to FIG. 17, it will be understood that the corrugations extend completely around the entire circumference of the facing rim portions 64 and 66 of stems 56 and 58; only a portion of the said rim portions being depicted schematically in FIG. 17 as having the corrugations. The number of corrugations will be a matter of design and may, for example, be ninety whereby each corrugation will correspond to an angle of 4°. To alter the angle of inclination of the taphole, the securing nut 62 will be released and the drill support bar will be tilted by rotating stem 58 with respect to stem 56.

Figure 19:
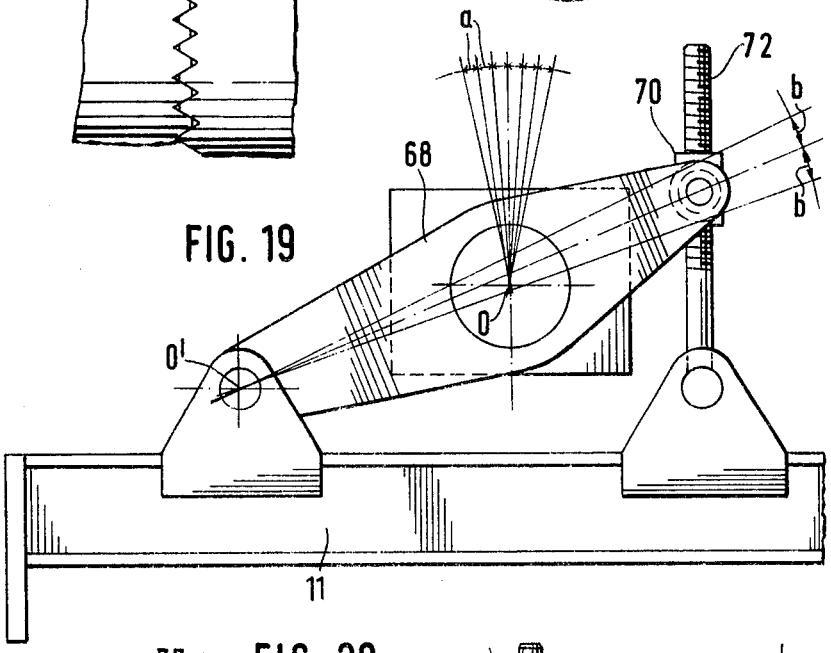

In FIG. 19, reference character "*a*" indicates the angular pitches by which the inclination of a drill support bar 11 may be adjusted about the longitudinal axis 0 of the arm 17. In the embodiment of FIG. 19, a second means is provided for steplessly adjusting the angle of inclination of bar 11 about a second axis 0' which is displaced from axis 0. The second axis 0' is formed by the center of articulation of the connection between the support bar 11 and one end of an arm 68 which is integral with the stem 58 (FIG. 16). The opposite end of arm 68 is affixed to a coupling 70 which is slideably engaged on a threaded rod 72. Rod 72 is connected to support bar 11 by means of an articulated or pivot connection. The sliding movement of rod 72 with respect to coupling 70, and thus the pivoting movement of bar 11 about the axis 0', may be adjusted in the same manner as described above with respect to coupling 55 of the embodiment of FIGS. 13–15. In contradistinction to the stepwise angular adjustment permitted by the securing system of FIG. 16, the additional adjustment about axis 0' permitted by the apparatus of FIG. 19 is continuous. The reference characters "*b*" on FIG. 19 provide a schematic illustration of the pivoting movement of support bar 11 about axis 0' resulting from the sliding movement of rod 72 in coupling 70. The assembly shown in FIG. 19 may be replaced by a similar assembly serving to obtain an angular adjustment of bar 11 about the axis 0 or about the axis of the other fastening.

The arm 17, by which the drill support bar 11 is mounted on the support column 19, may consist of a single arm or a double arm which forms, with bar 11, a parallelogram type linkage which becomes deformed during the swinging movement of arm 17. Arm 17 is preferably rotated about the longitudinal axis of the support column 19 through the use of a hydraulic jack. The manner of mounting the hydraulic jack may be similar to the mounting disclosed in U.S. Pat. No. 3,765,663; i.e. the piston rod of the hydraulic jack may act directly on the arm 17 in a 120° type machine. Alternatively, the hydraulic jack may be mounted such that its cylinder is displaceable and acts directly on the arm 17 via an intermediate hinged stirrup.

Taphole drilling machines in accordance with the prior art generally include a locking mechanism which serves to secure to the drilling machine in the working position. Such locking mechanisms have previously consisted either of hooks, by which the drilling machine is secured to the wall of the furnace, or limit stops for blocking the driving device for the tool such as, for example, by blocking the arm in a preselected position. In accordance with the present invention no mechanical means for locking the drilling machine in the operating position is required whereby the drilling machine is simplified and thus of enhanced reliability.

In order to immobilize the tool support bar 11 in the desired position during the drilling of the taphole, the present invention provides for the displacement of the piston of the hydraulic jack actuating the arm 17 to its limit of travel and for the maintenance of the pressure of the hydraulic fluid with the arm in this position. The movements and dimensions of the various elements of the drilling machine must thus be coordinated in such a way that the position selected; i.e., the limit of travel of the hydraulic piston; corresponds to the operating position of the drill mounted on the bar 11. In order to provide compensation for any manufacturing or assembly inaccuracies, and to enable the drill hole to be displaced laterally, the present invention includes means for adjusting the working position.

Figure 20:
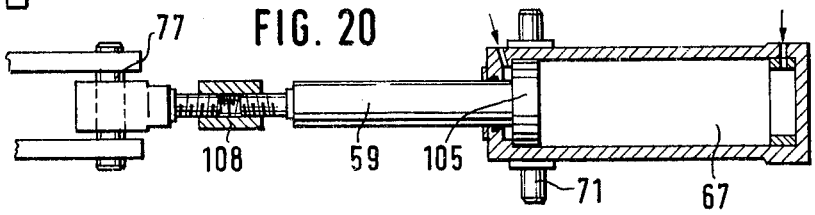
FIGS. 20 and 21 are schematic diagrams of the longitudinal sections through two embodiments of the hydraulic jack for swinging the drilling machine.
Figure 21:
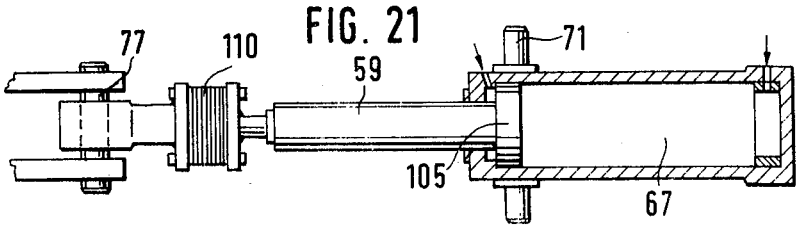

Referring now to FIGS. 20 and 21, two embodiments are shown wherein the retracted position of the drilling machine is 120° from its operative position. In FIGS. 20 and 21 the hydraulic jack actuator, and particularly the cylinder defining portion thereof, is indicated at 67. The actuator includes a piston 105 which travels in cylinder 67. Means are provided in both of the embodiments of FIGs. 20 and 21 for adjusting the length of the piston rod 59 connected to the piston 105 of the hydraulic jack in order to insure that the limit of travel of the piston corresponds to the desired working position of the drill carried by support bar 11 and arm 17; the support bar having been omitted from FIGS. 20 and 21 in the interest of facilitating understanding of the invention. The piston rod 59, in both embodiments, acts on a pin 77 held between two lugs at the end of the arm 17.

In the embodiment of FIG. 20 the means for adjusting the length of piston rod 59 comprises a screw-threaded tension coupling 108 installed intermediate the ends of rod 59. In the embodiment of FIG. 21, a set of interposed segments or shim plates, the number of which may be increased or reduced as necessary to obtain the desired length for piston rod 59, is connected between the main body of the piston rod and the connector which engages pin 77. The hydraulic jack is mounted on a pivot 71 in order to accommodate changes in orientation incident to the swinging movement of the arm 17. In the embodiments of FIGS. 20 and 21 the hydraulic jack is actuated so as to drive piston 105 to its limit of travel and the pressure of the hydraulic fluid is maintained during the taphole drilling operation. This technique avoids the necessity of providing for any mechanical devices to lock the bar 11, arm 17 or piston rod 59 in the working position.

FIGS. 22 through 25 are schematic diagrams comprising longitudinal sections through different constructional embodiments of a hydraulic jack 81 which may be employed to cause rotation of the arm 17 through 180° . Thus, in accordance with the embodiments of FIGS. 22–25, and in contradistinction to the apparatus depicted in FIGS. 20 and 21, the cylinder 107 of the actuator is displaced relative to the piston 109 and the piston rod 83. The cylinder 107 is coupled, via a journal 93 and an intermediate stirrup, not shown, to the arm 17. The piston rods 83 of the embodiments of FIGs. 22–25 are mounted on fixed position pivots 87 which correspond to the pivot 71 of FIGS. 20 and 21. Hydraulic fluid is transmitted to cylinder 107 through a central bore 111 provided in the piston rod 83 and piston 109 in order to cause movement of cylinder 107 to its limit of motion which will correspond to the operative position of the drilling machine as shown in FIG. 22. The provision of a path for operating fluid through the piston rod is necessitated by the mobility of cylinder 107. In order to cause the drill to be moved from the operative to the retracted position, hydraulic fluid is injected into cylinder 107 via an annular passage 113 which surrounds the bore 111 to thus urge the cylinder to the position depicted in FIG. 25.

As in the case of the embodiments of FIGS. 20 and 21, in the alternatives of FIGS. 22–25 the drilling machine is maintained in its operative position by means of the maintenance of the pressure of the hydraulic fluid. Thus, the limit of motion of the cylinder 107 with respect to the piston 109 will determine the operative position of the drilling mechanism. Since the operating fluid is delivered to the interior of cylinder 107 via the piston rod 83 in the embodiments of FIGS. 22–25, adjustment of the operating position of the drilling machine by means of varying the length of the piston rod, as was done in the case of the embodiments of FIGS. 20 and 21, presents certain difficulties. Thus, other means for determining the operative position of the drilling machine are desirable.

In the embodiment of FIGS. 22 and 23 the hydraulic jack is actuated so as to cause cylinder 107 to move relative to piston 109 to its limit of travel; this position being depicted in FIGS. 22 and 23. In order to insure that the limit of relative movement between the cylinder 107 and piston 109 corresponds to the desired operating position of the drill, the point of attachment of cylinder 107 to journal 93 is made adjustable. In the embodiment of FIG. 22 the adjustable connection takes the form of an external thread on cylinder 107 and a pair of adjusting nuts 104 and 106 which engage this external thread and determine the positioning of journal 93 on the cylinder. In the FIG. 23 embodiment the cylinder 107 includes a flange 115 which is coupled to journal 93 via connecting rods 117 and 117'. The spacing between flange 115 and journal 93 is adjustable, for example through the use of pairs of nuts such as nuts 104 and 106 of the FIG. 22 embodiment, whereby the position of journal 93 on the cylinder may be regulated.

In the embodiment of FIGS. 24 and 25 the travel of cylinder 107 is delimited by external stops rather than by displacing the cylinder to its limit of travel relative to the piston. Thus, rods 119 and 119' are provided. These rods pass through the journal 93 and are fixedly attached to the pivot 87. Accordingly, the journal 93 slides on rods 119 and 119' during operation of the hydraulic jack. FIGS. 24 and 25 respectively illustrate the two extreme positions of cylinder 107. As shown in FIG. 24, the limit of motion in a first direction is determined by contact of journal 93 with nuts 121 and 121' mounted on rods 119 and 119' respectively. The opposite limit of motion occurs when the piston bottoms in cylinder 107 as depicted in FIG. 25.

It should be obvious to those skilled in the art that the movement of the drilling machine has been described as being through an arc of 120° or 180° for example purposes only and that other angular relationships may be selected depending upon the requirements and possibilities of a particular installation.

As should also be obvious to those skilled in the art, the need for adjusting means such as depicted in FIGS. 20–25 increases with increases in the lengths of arm 17 and bar 11. The longer the arm and bar, the greater the displacement of the drilling tool for each increment of displacement of the hydraulic actuator piston or cylinder. Also, manufacturing and assembly tolerances are magnified by increases in the lengths of the arm 17 and bar 11.

It should further be obvious to those skilled in the art that the holding of the drilling machine in the operative position solely under the influence of hydraulic pressure affords better damping of vibrations when compared to the prior art mechanical locking means and thus enhances the lift expectancy of the apparatus.

FIG. 26 schematically depicts the present invention with the drilling machine 13 shown mounted on the support bar 11 in solid lines in its retracted position and in broken lines in its forward or drilling position. The means for actuating the drilling machine 13 so as to displace it on bar 11 are well known and do not comprise part of the present invention. The present invention, however, encompasses novel means for the delivery of hydraulic or pneumatic motive fluid to the drilling machine 13. Thus, in accordance with a first embodiment, the feed of motive fluid to drill 13 is effected via a rigid conduit system 125 having articulated joints 127; the articulated joints 127 allowing the conduit system to follow the movements of the drill. As may be seen from FIGS. 28–30, the requisite number of fluid flow paths for operating drill 13 can be established within the conduit system 125. Thus, in FIG. 28, the conduit system 125 comprises an outer pipe 128 and two small inner pipes 131 and 133 whereby three different fluids may be circulated without intermixing. In FIG. 29 the conduit system 125 consists of three concentric pipes 135, 137 and 139. The fluid transmission system of FIG. 30 comprises an inner conduit 143 and an outer conduit 141.

FIG. 27 represents an exemplary articulated joint 127 for the conduit system of FIG. 26. For purposes of explanation, the joint 127 of FIG. 27 is shown as having been designed for a double conduit system such as that shown in FIG. 28. It will be understood, however, that the joint 127 of FIG. 27 could be adapted to systems with three, four or more conduits.

Continuing with a discussion of FIG. 27, the joint 127 consists of a tubular outer member 145 which receives a cylindrical inner member 147; the inner and outer members being hermetically sealed one to the other in such a manner that rotational motion therebetween is not precluded. The outer member 145 is connected to one of the branches of the conduit system, two path conduit 149 in the example shown, while the inner member 147 is coupled to a continuing two path conduit section 151. The inner member 147 is provided with passages 153 and 155 which respectively establish communication between the outer and inner flow paths of the sections of the conduit system. The connections with conduit section 151 are direct whereas the connections with the conduit section 149 is established via peripheral grooves 157 and 159 formed in the outer wall of inner member 147. The outer member 145 is provided, in its lateral wall, with radial passages 161 and 163 which communicate at first ends with respective of the grooves 157 and 159 and at their other ends with the separate pipes of conduit section 149. Diassembly of the joint for servicing is permitted by sectioning the inner member 147 and employing bolts, such as bolt 165, to hold the components of the joint together. A plurality of sealing rings 167 are provided to insure against leakage of fluid either out of the joint or intermixing of the fluid in the peripheral grooves 157 and 159.

As a consequence of the employment of the rigid piping system of FIG. 26, and particularly the articulated joints 127 which permit the piping system to perform pivoting and bending movements in one plane, the present invention eliminates the problem of entanglement of the comparatively large number of flexible tubes which are suspended from and about drilling machines which has been prevalent in the prior art. The importance of this advantage may be appreciated when it is recognized that the actual drills presently favored for use in furnace taphole drilling apparatus are of the percussive type which require several distinct pneumatic supply lines. In the case of a percussive drilling tool the motive fluid must be supplied in such a manner as to actuate the apparatus in both directions. Furthermore, if the percussion mechanism is separated from the drill mechanism a further pneumatic feed line is required. Additionally, in some instances the drilling machine is equipped with a blower which is employed to remove cuttings from the taphole during the drilling operation.

The articulated piping system can be mounted in either of two different ways in accordance with the space available. A first mounting system is depicted by double solid and broken lines at 125 in FIG. 26. A second technique is also depicted on FIG. 26 by means of a single continuous and a single broken line 125'.

Figure 31:
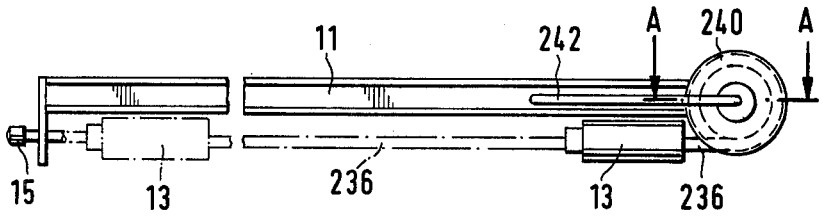
FIGS. 31–33 show winding reels for the flexible feed conduits for the hydraulic or pneumatic fluid, for different positions of the operating tool in relation to the tool holder bar.

Referring now to FIGS. 31–35, a further embodiment of a drill motive fluid feed system is depicted. In FIG. 31, the supply of hydraulic or pneumatic fluid to the drill 13 is effected by means of a flexible conduit 236 which is unwound from a reel 240 as the drill is fed forwardly along the support bar 11. The reel 240 is mounted at the end of bar 11 which will be disposed away from the furnace taphole. Reel 240 will be spring loaded whereby the flexible conduit 236 will be rewound as drill 13 is returned to the retracted position as shown in full lines in FIG. 31. A feed conduit 242 for the fluid communicates with flexible conduit 136 via the hub of reel 240. It is also possible to eliminate the reel drive spring and couple reel 240 to the mechanism which drives drill 13 along support bar 11 whereby the reel will be automatically rotated synchronously with the traversing movement of the drill 13.

Figure 33:
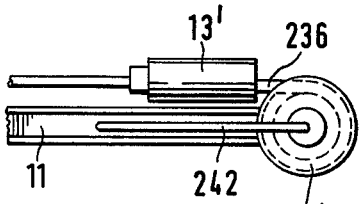

FIG. 33 shows a similar construction to that illustrated in FIG. 31 with the exception that the drill 13' is mounted above support bar 11 rather than from the bottom of the bar as shown in FIG. 31. The reel 240' of FIG. 33 is mounted, similarly to the reel 240 of FIG. 31, on bar 11 and will be caused to rotate either under the action of a spring or by being coupled to the drive mechanism for the drill. The direction of rotation of the reel is, of course, opposite in the embodiments of FIGS. 31 and 33.

Figure 32:
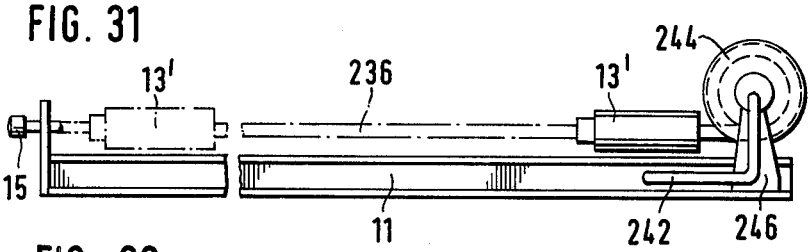

Referring to FIG. 32, the drill 13' is mounted on top of the support bar 11 in the same manner as discussed above with respect to FIG. 33. A reel 244 is provided, mounted on a suitable support 246 above bar 11, and the hydraulic or pneumatic fluid for operating drill 13 is delivered, via a feed conduit, through the hub of reel 244.

The arrangements of FIGS. 31–33 can be adapted to local circumstances and to the space available for a suitable assembly. The principal advantage offered by a system in which the means for supplying motive fluid to the drill is wound onto a reel is the fact that the conduit means are always in place when the drill occupies its retracted position and thus are not inconveniently suspended below the support bar 11 and possibly above the tap spout. If two or more separate conduits for hydraulic or pneumatic fluid are required, it is possible to provide for a plurality of separate reels or for winding up a pair of flexible conduits side-by-side on the same reel.

Figure 34:
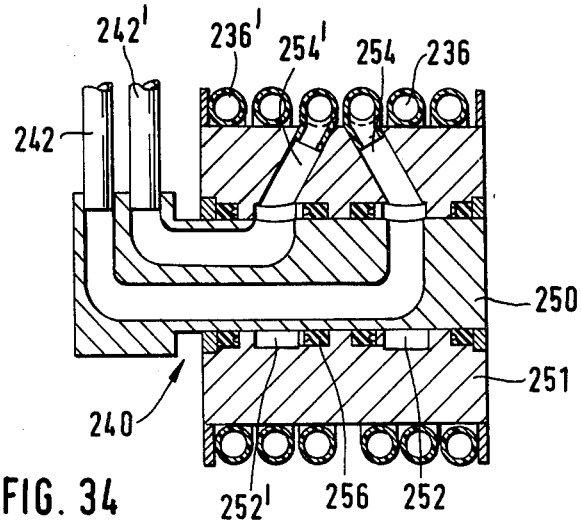
FIG. 34 shows a rotary passage for the feed of the hydraulic or pneumatic fluid through the hub of the reel.

FIG. 34, which is a schematic cross-sectional view taken along line A—A of FIG. 31, illustrates the possibility of providing for a pair of flexible conduits mounted on the same reel. In FIG. 34 supply conduits 242 and 242' enter the rotatable hub 254 of reel 240 via the fixed axle 250 thereof; axle 250 being provided with bores which define conduit extensions. Conduits 242 and 242' terminate respectively in peripheral annular grooves 252 and 252' defined by hub 254 and axle 250. These peripheral grooves respectively communicate, via radial conduits 254 and 254' formed in hub 254, with the flexible conduits 236 and 236' which are wound up on the reel; the feed conduits 242 and 242' being constantly in communication with the flexible conduits 236 and 236' as the hub 254 of reel 240 rotates with respect to axle 250. A plurality of sealing rings are employed to isolate the peripheral grooves 252 and 252' from each other and to prevent leakage out of the closed fluid supply system.

It should be obvious that the supplying of fluid to a single flexible conduit may be accomplished in the same manner as depicted for a pair of conduits in FIG. 34. Similarly, more than two conduits may be utilized and/or multiple conduits such as those described above in the discussion of FIGS. 28–30 may be employed.

Figure 35:
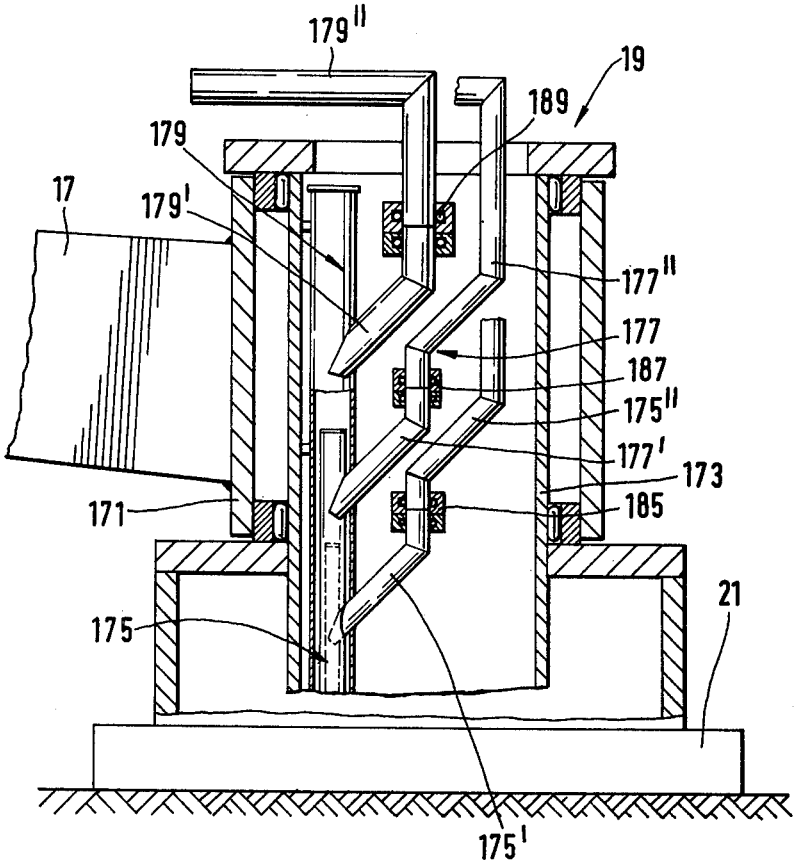
FIG. 35 is a vertical section through the support column about which the stem pivots.

FIG. 35 depicts how pneumatic or hydraulic fluids may be delivered to the drilling machine through the support column 19. To this end, the support column may comprise a fixed internal cylinder 173 and a coaxial external cylinder 171. The external cylinder 171 is capable of pivoting about the internal cylinder 173 and is integral with the arm 17. The delivery of the pneumatic or hydraulic fluid required for operation of the drilling machine may be effected through conduits 175, 177 and 179 located within the inner cylinder 173 of column 19. It will be understood that three conduits have been shown by way of example only and a greater number may be provided if necessary or desired. Each of conduits 175, 177 and 179 comprises a fixed lower section 175', 177' and 179' and a movable upper section 175'', 177'' and 179''. The connection between the upper and lower sections of the respective conduits is defined by swivel joints as indicated at 185, 187 and 189. These swivel joints, while insuring hermeticity between the adjacent ends of the conduit sections, permit the upper sections to rotate in relation to the lower sections. Thus, the swivel joints 185, 187 and 189 must be located on the axis of rotation of cylinder 171. The arrangement of FIG. 35 contributes to the reduction in the total height of the drilling machine since, in the prior art, the means for supplying the operating fluid for the drilling machine was typically located above the support column.

It may also be observed that the conduits 175, 177 and 179, while shown as being of the single passage type, may be of the multiple passage type such as shown in FIG. 29.

While preferred embodiments have been shown and described, various modifications and substitutions may be made thereto without departing from the spirit and scope of the invention. Accordingly, it will be understood that the present invention has been described by way of illustration and not limitation.

What is claimed is:

1. Apparatus for opening shaft furnace tapholes, the furnace having a vertical axis and an external longitudinally extending molten metal flow channel in registration with each taphole, the apparatus comprising:

support column means, said support column means having a longitudinal axis which is angularly inclined toward the furnace axis, said column means longitudinal axis also being angularly inclined with respect to a vertical plane through the taphole and the axis of the flow channel in registration with the taphole with which the apparatus cooperates;

arm means pivotally mounted on said support column means and extending outwardly therefrom, said arm means having an axis;

tool holder means, said tool holder means including an elongated tool support bar;

means for rigidly attaching said tool holder means support bar to a first end of said arm means, said attaching means permitting adjustment of said tool holder means support bar relative to said arm means;

fluid operated drill means mounted on said tool holder means support bar for movement along said bar;

means for delivering operating fluid to said drill means; and means for rotating said arm means about the axis of said column means to move said tool holder means between operating and retracted positions, said rotating means including a hydraulic actuator having a movable output member coupled to said arm means, said rotating means further including means for limiting the displacement of said actuator output member to an amount corresponding to the operating position of said tool holder means.

2. The apparatus of claim 1 wherein said means for attaching said tool holder means support bar to said arm means is manually adjustable to vary the vertical relationship between said arm means axis and the longitudinal axis of said tool holder means support bar.

3. A drilling machine as claimed in claim 1, comprising one or more removable intermediate pieces, each of which can be mounted between the free end of the stem and the tool holder bar, each of these pieces forming a different angle with the longitudinal axis of the stem when the pieces are mounted.

4. A drilling machine as claimed in any one of claims 1, wherein the tool holder bar is affixed to the stem in a semi-rigid manner, this system consisting of two parallel plates of which the two ends are flexibly connected to the free end of the stem and to a plate integral with the bar, respectively, while a rod adjustable in its length diagonally connects one of the ends of one plate to the opposite end of the other plate.

5. The apparatus of claim 1 wherein said means for attaching said tool holder means support bar to said arm means is adjustable to permit rotation of said tool holder means bar about the axis of said arm means.

6. The apparatus of claim 5 wherein said rotation permitting means comprises:

cheeks of complementary shape integral with said tool holder means support bar and said arm means; and a collar firmly interconnecting said cheeks.

7. The apparatus of claim 6 further comprising:

means for preventing the accidental pivotal movement of said tool holder means bar when said collar is released.

8. The apparatus of claim 7 further comprising:

a ring comprised of a material having a high coefficient of friction interposed between said cheeks.

9. The apparatus of claim 5 wherein said rotation permitting means comprises:

first connector means integral with said arm means;

second connector means, said second connector means being in juxtapositioned facing relationship to said first connector means;

means coupling said second connector means to said tool holder means support bar; and means for preventing relative motion between said connector means during operation of said apparatus.

10. The apparatus of claim 9 wherein the adjacent surfaces of said connector means have complementary shaped cooperating irregular contours.

11. The apparatus of claim 9 wherein said second connector means is coupled to said tool holder means support bar at a pair of displaced points, one of said points comprise an articulated connection, and the other of said points is defined by a mechanical connection which is adjustable in length.

12. The apparatus of claim 11 wherein said adjustable mechanical connection is defined by a threaded rod, said rod being pivotally connected at a first end to said tool holder means bar by a first coupling means, said mechanical connection further being defined by a second coupling means having a complementary thread, said second coupling being carried by a first end of a lever arm, the second end of said lever arm being pivotally connected to said tool holder means bar by a third coupling means to define said articulated connection.

13. The apparatus of claim 12 wherein the adjacent surfaces of said connector means have complementary shaped cooperating irregular contours.

14. Apparatus of claim 12 wherein said means for delivering operating fluid to said drill means comprises:

a rigid conduit system, said rigid conduit system including plural tubes serially interconnected by a plurality of articulated joints whereby the configuration of said conduit system may be varied without interrupting fluid communication to said drill means.

15. The apparatus of claim 14 wherein said means for limiting the displacement of said rotating means hydraulic actuator output member comprises:

means for varying the length of said output member.

16. The apparatus of claim 15 wherein the adjacent surfaces of said connector means have complementary shaped cooperating irregular contours.

17. The apparatus of claim 1 wherein said means for limiting the displacement of said rotating means hydraulic actuator output member comprises:

means for varying the length of said output member.

18. Apparatus of claim 1 wherein said means for delivering operating fluid to said drill means comprises:

a rigid conduit system, said rigid conduit system including plural tubes serially interconnected by a plurality of articulated joints whereby the configuration of said conduit system may be varied without interrupting fluid communication to said drill means.

19. A drilling machine as claimed in claim 1 wherein the hydraulic or pneumatic fluid is fed through flexible conduits which are unwound from a reel supported by the tool holder bar, by the traction of the operating tool and/or by coupling it to the traversing mechanism, during the advance of the latter, and which are then wound onto the said reel during the return movement of the operating tool, the feed of fluid into these conduits being effected via rotatory passages in the hub of the reel.

20. A drilling machine as claimed in claim 19, comprising several flexible conduits to feed the hydraulic or pneumatic fluid to the operating tool, these conduits being wound side by side onto the same reel.

21. A drilling machine as claimed in claim 20, wherein the feed of the fluid into the rotatory passage of the hub of the reel is effected via separate conduits.

22. A drilling machine as claimed in claim 21, wherein the feed of fluid into the rotatory passages of the hub of the reel is effected via multiple conduits positioned one inside the other or others.

23. A drilling machine as claimed in claim 1 wherein said support column means is hollow and contains swivels positioned axially and ensuring hermeticity and also rotatability between upper sections and lower sections of the pipes serving to feed hydraulic or pneumatic fluid through the support column.

* * * * *